United States Patent [19]
Enderby et al.
[11] 4,210,886
[45] Jul. 1, 1980

[54] ISOLATOR HAVING REACTIVE NEUTRALIZING MEANS AND PREDETERMINED ANGLE BETWEEN INPUT-OUTPUT WINDINGS

[75] Inventors: Ralph T. Enderby; Lawrence N. Dworsky, both of Coral Springs, Fla.

[73] Assignee: Motorola, Inc., Schaumburg, Ill.

[21] Appl. No.: 943,077

[22] Filed: Sep. 18, 1978

[51] Int. Cl.² ..... H01P 1/36
[52] U.S. Cl. ..... 333/24.2; 333/245
[58] Field of Search ..... 333/24.2

[56] References Cited

U.S. PATENT DOCUMENTS 2,944,229 7/1960 De Vries ..... 333/24.2
3,010,085 11/1961 Seidel ..... 333/24.2
3,038,133 6/1962 De Vries ..... 333/24.2
4,016,510 4/1977 Hodges et al. ..... 333/24.2

*Primary Examiner*—Paul L. Gensler
*Attorney, Agent, or Firm*—Margaret Marsh Parker; James W. Gillman

[57] ABSTRACT

A broadband isolator design wherein the amount of insertion loss may be traded for bandwidth and possibly reduced circuit complexity. The isolator may employ two windings or conductors with the neutralizing element connected across the input-output terminals, or may have a third winding placed to bisect the angle between the other windings and the neutralizing element coupled across this third winding. The angle between the windings and the isolator interconnection determine the specific bandwidth and insertion loss.

4 Claims, 7 Drawing Figures $$I.L. = 20\log\left[1+\frac{\alpha(1+\cos\theta)}{\sin\theta}\right] \quad \text{(2 CONDUCTOR)}$$

$$I.L. = 20\log[1+\alpha\tan\phi] \quad \text{(3 CONDUCTOR)}$$

FIG. 5
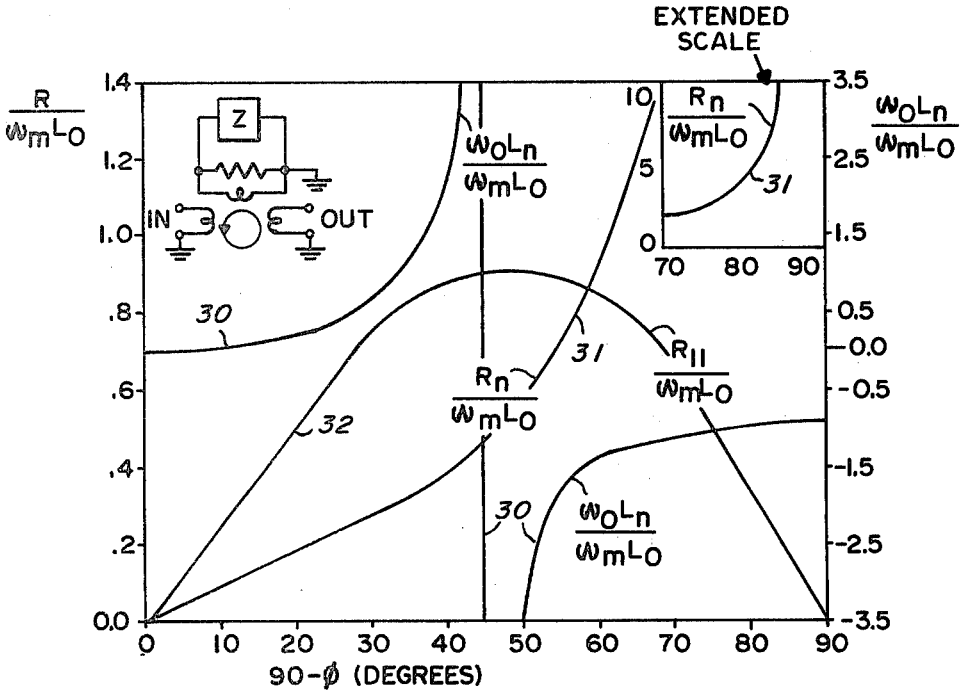
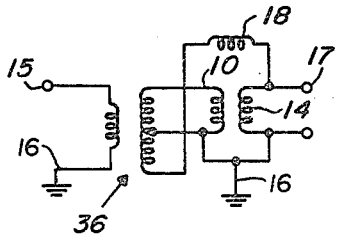
FIG. 7
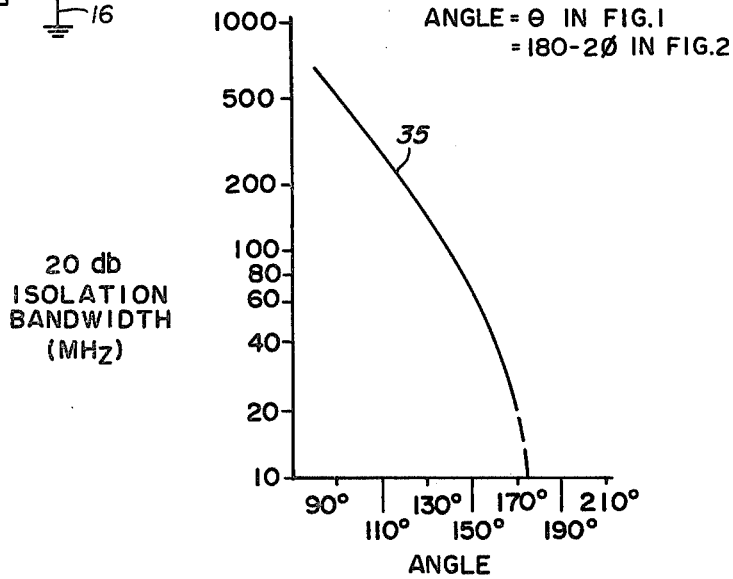
FIG. 6

ISOLATOR HAVING REACTIVE NEUTRALIZING MEANS AND PREDETERMINED ANGLE BETWEEN INPUT-OUTPUT WINDINGS

BACKGROUND ART

This invention relates to the field of non-reciprocal electrical coupling devices, and more particularly to isolators utilizing ferrite gyromagnetic elements in which the amount of isolation and the bandwidth are a function of the angle between the longitudinal axes of the conductors.

Isolators, circulators and gyrators of many kinds are known in the art for providing non-reciprocal coupling between two circuits in an electrical apparatus. Possible applications include isolating an antenna from the RF stage of a transmitter, or a VCO from load variations, or between sections of a bandpass filter network. One such isolator, having two conductors adjacent a ferrite disc and in a static magnetic field, is shown in U.S. Pat. No. 4,016,510, assigned to the same assignee as is the present invention. In this device, maximum possible bandwidth was achieved by positioning the two conductors with their main axes at 90° to each other, with one end of each grounded and the ungrounded ends coupled to the respective ends of a neutralizing resistor which was also coupled from the input to the output terminal. Since the bandwidth is determined by the neutralizing element which in that case was non-reactive, and the device was not operated at its magnetic resonance, the bandwidth of the patented device was maximal. While the insertion loss in such a device is fairly low, there are applications wherein it is necessary to reduce even this small loss, and a trade-off of less bandwidth for reduced insertion loss would be advantageous.

SUMMARY OF THE INVENTION

It is therefore an object of the present invention to provide a non-reciprocal coupling device in which a specific combination of values for isolation and bandwidth can be achieved.

This and other objects are achieved in an isolator in accordance with the present invention wherein two conductors are positioned between gyromagnetic elements and the combination is held within a substantially uniform static magnetic field. The two conductors are juxtaposed with the longitudinal axis of one at a predetermined angle to the longitudinal axis of the other, the bandwidth of the isolator being a function of the predetermined angle. A neutralizing element is coupled to provide optimum neutralization at the desired operating frequency and can be positioned in one of two configurations, depending on external factors.

BRIEF DESCRIPTION OF THE DRAWING

FIG. 5 is a chart of the normalized impedance values for the embodiment of FIG. 2.

FIG. 6 is a chart of bandwidth versus $\phi$for a given isolation loss.

FIG. 7 is a schematic diagram of one circuit connection for the isolator of FIG. 2.

DETAILED DESCRIPTION OF A PREFERRED EMBODIMENT

Figure 1:
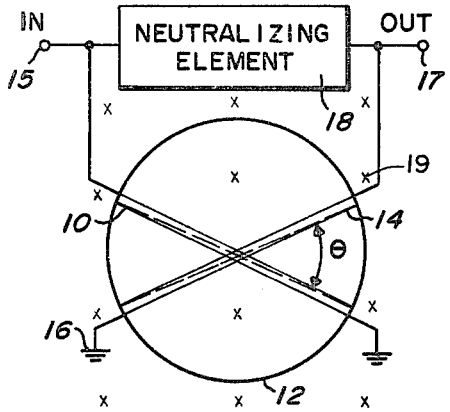
FIG. 1 is a schematic drawing of one embodiment of the isolator of the invention.

An isolator is by definition a circuit element having at least two ports or points of signal entry wherein signals are transferred from a first port to a second port with negligible attenuation or insertion loss, but signals inserted at the second port experience great attenuation (30db or more) before appearing at the first port. The present invention is an isolator wherein a designer, knowing either the maximum forward attenuation he can tolerate, or the minimum bandwidth he requires, can chose the appropriate angle $\theta$ between the conductors or windings of the isolator to achieve the desired results.

The invention will be best understood with reference to the drawing wherein like parts have like reference numerals throughout.

Figure 2:
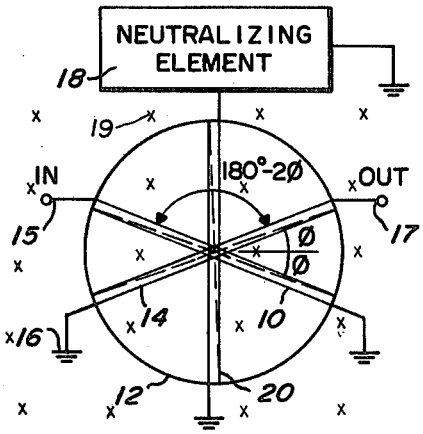
FIG. 2 is a schematic drawing of a second embodiment of the invention.

In FIG. 1 a schematic representation of a preferred embodiment is shown. A first conductor 10, which may be a single wire or strip or a coil, is placed upon or around a ferrite disc 12. A second conductor 14 is juxtaposed but insulated from the first conductor 10 with their respective long axes in substantially the same plane and forming an angle $\theta$ between the axes. The first conductor 10 is connected between an input terminal 15 and a point of reference voltage 16, indicated here as a ground point. The second conductor 14 is connected between an output terminal 17 and the reference terminal 16. A neutralizing element 18 is coupled between the input terminal 15 and the output terminal 17. A uniform static magnetic field represented by the "x's" 19, envelops the conductors 10 and 14 and the ferrite element 12, with lines of force perpendicular to the planes of the ferrite disc and the conductors. In FIG. 2 a different embodiment is shown with conductors 10 and 14 placed at the angle $\theta$ $2\phi$, positioned against the ferrite disc 12 and coupled to the terminals 15, 16 and 17 as in FIG. 1. Again the entire arrangement is within a uniform static magnetic field. A third conductor 20 is placed adjacent the first and second conductors with its long axis bisecting the angle $180°-\theta$ and with one end coupled to the reference terminal 16. The neutralizing element 18 is here coupled across the third conductor 20.

Figure 3:
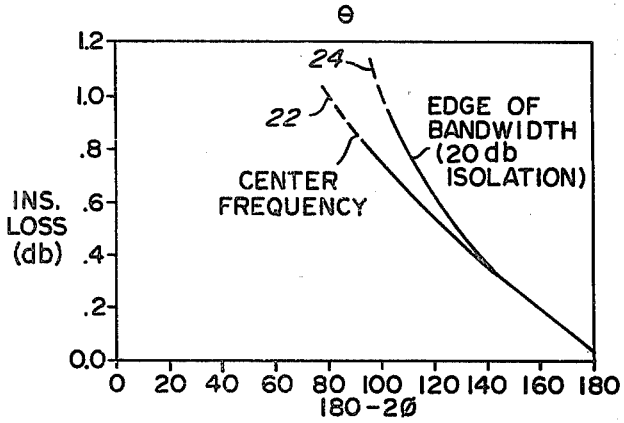
FIG. 3 is a chart plotting insertion loss as a function of the angle $\theta$, or 180° minus $2\phi$, for the embodiments of FIGS. 1 and 2 respectively.

FIG. 3 is a graph of insertion loss in db versus the angle $\theta$ in degrees for the embodiment of FIG. 1 and versus $180-2\phi$ for the embodiment of FIG. 2. A single pair of curves is shown for both embodiments since the data is essentially identical for both. The insertion loss for the two-wire isolator may be calculated from the formula $I.L.=20 \log [1+\alpha(1+\cos\theta)/\sin\theta]$. The insertion loss for the three-wire isolator is calculated from the formula $I.L.=20 \log [1+\alpha \tan \phi]$. The curve 22 shows the loss at the center frequency and the curve 24 loss at the edge of the bandwidth (20 db down). It will be seen on curve 22 that at $\theta<70°$, the insertion loss is more than 1.2 db, an excessive loss for most applications. The loss decreases as the angle $\theta$ increases toward 180°. It should be noted that in the formula given hereinabove, $\alpha$, the ferrite loss parameter, has a value of 0.1, a typical value for YIG ferrites.

Figure 4:
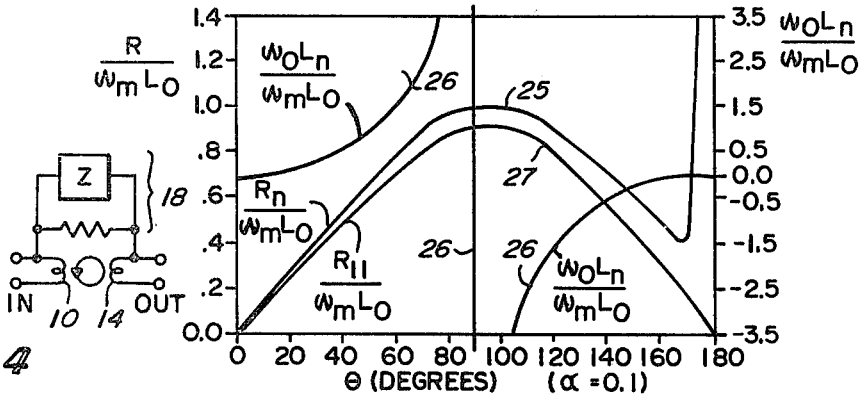
FIG. 4 is a chart of the normalized values for the impedances of the embodiment of FIG. 1.

FIG. 4 is a chart of the neutralizing network values for the embodiment of FIG. 1 and is a plot of reactance and resistance versus the angle $\theta$. The values of resistance and reactance are normalized by a common factor, which is a function of frequency, and the reactance is plotted as both positive and negative inductance.

Curve 25 of FIG. 4 is a normalized plot of the resistance value of the neutralizing element 18 and three-part curve 26 is the impedance value of the element 18. The curve 27 is the input resistance of the isolator after neutralization.

It should be noted here that the impedance for the special value $\theta=90°$ is a point where the reactance passes from positive to negative values through zero, and the impedance of the network is simply resistive. This special-valued point was the subject of the above-referenced U.S. patent. The present invention deals only with those values of $\theta$ for which the impedance of the required neutralizing network is partially reactive.

It should also be noted that the area where $\theta=-\text{arc tan } \alpha(\theta$ is approximately 175°) is also a special point. At this point, $R_n$ approaches infinity and the isolator is neutralized by a pure reactance. This point has the lowest insertion loss which is practically realizable with passive elements since, although as seen in FIG. 2 a decreasing insertion loss would be obtained when $\theta$is greater than 175°, this would require a value of $R_n$ less than zero.

FIG. 5 is a chart of impedance values for the embodiment of FIG. 2. A three-part curve 30 provides reactance values for the neutralizing network of the three-winding isolator. The resistance of the network is indicated by curve 31 which has an extended scale portion in the upper right-hand corner of the graph. Curve 32 is a graph of the values of the input impedance of the network after neutralization.

While the embodiments of FIGS. 1 and 2 can be shown to be essentially identical electrically, and to provide most of the same benefits, there are two extra advantages to the three conductor isolator of FIG. 2. The addition of the third conductor, bisecting the angle between the conductors 10 and 14, allows the neutralizing element to be connected to the reference terminal 16 instead of "floating" and makes construction of the device to avoid stray inductance much simpler. A second advantage is that voltage tunable elements; i.e., PIN diodes or varactors can be used as neutralizing elements. This can only be done in the two conductor isolator by introducing loss-producing blocking capacitors into the RF line.

FIG. 6 is a graph of the bandwidth obtainable in a typical isolator operating at 900 MHz for a range of values of $\theta$ or $180°-2\phi$. The curve 35 represents 20 db isolation values which is more or less a standard in the industry. Actual models made and tested for a specific application will provide 30 db isolation over the entire 840–960 MHz band.

In FIG. 7, the isolator of FIG. 2 is shown with a possible circuit connection of a positive broadband neutralizing inductor 18 for use when a negative inductance is called for (as shown by the rightmost portion of curves 26 and 30 in FIGS. 4 and 5 respectively). While a simpler circuit using an inverting transformer between the input 15 and the conductor 10 and coupling the neutralizing element 18 to the terminal 15 is possible, a broadband inverting transformer is difficult to realize. In the circuitry shown in FIG. 7, a transformer 36 with a center-tapped secondary winding is used. The transformer primary is coupled across terminals 15 and 16. One side of the secondary winding is coupled to the conductor 10 and the opposite side (180° out of phase) is coupled to the neutralizing element 18. Since the phase relationship between the voltages applied to the conductor 10 and to the neutralizing element 18 remains constant, the broadband characteristic of the isolator is unaffected.

Thus there has been shown and described a broadband isolator providing an option for the designer to choose the best combination of insertion loss and bandwidth for the desired frequency band. While two embodiments have been shown as exemplifying the invention in the best modes known, it is intended to include all variations and modifications thereof which fall within the spirit and scope of the appended claims.

What is claimed is:

1. An isolator for use in radio frequency apparatus comprising in combination:

an input terminal;

an output terminal;

a reference voltage terminal;

first conductive means coupled across the input terminal and the reference voltage terminal;

second conductive means coupled across the output terminal and the reference voltage terminal, and positioned with its longitudinal axis in substantially the same plane as the longitudinal axis of the first conductive means and forming a first predetermined angle with said axis of the first conductive means, said angle having a value within one of the ranges 5° to 85° and 95° to 175°;

gyromagnetic means positioned in close proximity to the first and second conductive means with the major plane thereof parallel to the plane of the axes of said conductive means;

magnetic means for providing a substantially uniform static magnetic field and the first and second conductive means and the gyromagnetic means being positioned within and normal to said magnetic field; and reactive neutralizing means coupled to provide minimum insertion loss at said first predetermined angle between the conductive means.

2. An isolator in accordance with claim 1 wherein the reactive neutralizing means is coupled between the input terminal and the output terminal.

3. An isolator in accordance with claim 1 wherein the first predetermined angle is $2\phi$, the reactive neutralizingmeans comprises in combination a third conductive means positioned adjacent the first and second conductive means and having the longitudinal axis thereof in the same plane as the axes of the first and second means and bisecting the angle $180-2\phi$ and a reactance coupled across the third conductive means.

4. A broadband isolator for use in high frequency apparatus and comprising in combination:

an input terminal;

an output terminal;

a voltage reference terminal;

magnetic means for providing a substantially uniform static magnetic field;

a first conductive means coupled between the input terminal and the voltage reference terminal;

a second conductive means coupled between the output terminal and the voltage reference terminal;

gyromagnetic means positioned in close proximity to the first and second conductive means and parallel to the plane of the axes of said conductive means;

reactive neutralizing means coupled to the conductive means to provide optimum neutralization at the operational frequency;

the first and second conductive means and the gyromagnetic means being positioned within the magnetic field, the second conductive means being positioned adjacent the first conductive means with the longitudinal axis of the first conductive means being positioned at a predetermined angle from the longitudinal axis of the second conductive means, where the bandwidth of the isolator is a function of the predetermined angle and said angle has a value within one of the ranges 5° to 85° and 95° to 175°.

* * * * *